US007854406B2

(12) United States Patent
Neumann

(10) Patent No.: US 7,854,406 B2
(45) Date of Patent: Dec. 21, 2010

(54) AIR SEPARATOR FOR COMMINUTED MATERIALS

(75) Inventor: Eberhard W. Neumann, Huntersville, NC (US)

(73) Assignee: Koppern Equipment, Inc., Charlotte, NC (US)

( * ) Notice: Subject to any disclaimer, the term of this patent is extended or adjusted under 35 U.S.C. 154(b) by 218 days.

(21) Appl. No.: 12/283,363

(22) Filed: Sep. 9, 2008

(65) Prior Publication Data

US 2010/0038461 A1 Feb. 18, 2010

(51) Int. Cl.
*B02C 23/30* (2006.01)

(52) U.S. Cl. ..... 241/79.1; 209/3; 209/714

(58) Field of Classification Search ..... 241/79.1, 241/19, 43, 47; 209/714, 21, 139.2, 148, 209/3

See application file for complete search history.

(56) References Cited

U.S. PATENT DOCUMENTS 1,499,725 A * 7/1924 Holt ..... 209/137
2,113,586 A * 4/1938 Holt ..... 209/139.2
2,188,474 A * 1/1940 Holt ..... 209/139.2
4,427,541 A * 1/1984 Crosby et al. ..... 209/210
5,158,182 A * 10/1992 Fischer-Helwig et al. ... 209/135

* cited by examiner

*Primary Examiner*—Mark Rosenbaum
(74) *Attorney, Agent, or Firm*—Ralph H. Dougherty

(57) ABSTRACT

An air separator is provided with a rotor positioned above three concentric vessels. The rotor and a plurality of entry ports segregate comminuted material into the three vessels. An exit port from each vessel directs the separated comminuted material for further comminution processes, such as to a ball mill or a roll press, or for use as a final product.

9 Claims, 3 Drawing Sheets

AIR SEPARATOR FOR COMMINUTED MATERIALS

CROSS REFERENCE TO RELATED APPLICATION

This application claims the benefit of priority of PCT Application PCT/US08/00356, filed Jan. 10, 2008, and U.S. Provisional Patent Application Ser. No. 60/879,618, filed Jan. 10, 2007.

FIELD OF THE INVENTION

The present invention relates to air separators for use in conjunction with comminution equipment, such as high pressure roll presses and ball mills.

BACKGROUND OF THE INVENTION

High pressure roll presses have been used in cement processing with ball mills to increase throughput capacity and decrease the total energy expenditure in cement processing. These roll presses typically are the first stage in clinker grinding processing, and processing of other materials, with product from the press being directed to a ball mill or other machinery for further processing.

Typically in comminution processes for cement and other abrasive materials, an air separator has been used in conjunction with other grinding and comminution devices to improve separating and grinding efficiency. Comminuted material is introduced into a cyclonic vessel. Larger material falls to the bottom of the vessel and is removed via an exit port for further processing. Material fines suitable for use as a final product are removed from the comminuted material within the cyclonic vessel by vortical wind currents created by a fan. A slight vacuum is then typically employed to remove the fines from the cyclonic vessel from a second exit port typically at the top of the vessel or along the sides thereof, so as not to commingle the fines with the larger material exiting from the bottom exit port.

DESCRIPTION OF THE PRIOR ART

The Applicant is aware of the following US Patents concerning air separation of comminuted materials:

Longhurst et al. U.S. Pat. No. 6,889,843 discloses an air separator for particulate material. Particles of various sizes are introduced to a separating zone through which a gas stream flows at such volume and velocity as to entrain fine particles and convey them from the separating zone to grinding or other facilities. The fineness of entrained particles may be adjusted by diverting a selected portion of the gas stream from the separating zone to a bypass passageway followed by recombining the diverted portion of such gas stream with the gas containing the entrained particles.

Kimmeyer et al. U.S. Pat. No. 6,644,479 discloses an air separator for comminuted material having a sifting rotor. Air and comminuted material are introduced into a sifting chamber and blocking air is blown into a ring seal region in the transition region between the sifting rotor and a stationary withdrawal duct. Particle size distribution range in the fine material/end product is controlled by discharging fine material through a bypass stream. By controlling the supply of blocking air, the volume of the bypass stream can be changed, thereby regulating the size of the separated material.

Sparks et al. U.S. Pat. No. 6,631,808 discloses an air classifier with enhanced air flow which maybe used for the simultaneous recovery of two or more distinct grades of foundry quality sand from a single sand stream. The air classifier draws incoming air into the classification chamber through a honeycomb followed by a screen section having two or more screens, a vibrating screen feeder for spreading the incoming particle stream before entrainment in the air flow within the classifier can also be included.

Fischer-Helwig et al. U.S. Pat. No. 5,158,182 discloses a rotary separator for separating different fractions of particulate material. Material and air pass inwardly through a cylindrical outer housing and three rotary cages. Channels below the rotors collect the separate fractions of separated material.

Blasczyk et al. U.S. Pat. No. 4,792,393 discloses an air separator in which the spiral for delivery of the air for sifting is divided into a plurality of channels. The channels lie one above another and the quantity of air delivered to the individual channels can be adjusted. The degree of separation can be optimized by adjustably controlling air flow to each of the plurality of chambers.

SUMMARY OF THE INVENTION

The present invention provides various embodiments of a cyclonic air separator for the use in conjunction with the compressive comminution of granular material, including cement clinker.

The invention provides an air separator having a plurality of concentric vessels. A spiral inlet housing, thimble, guide vanes, and rotor are provided atop the vessels to provide vortical wind currents within the vessels, and segregates feed material into the various vessels based on particle size.

The invention further provides that separated feed material is withdrawn from one of a plurality of vessel exit ports, or discharge outlets, for use as a final product.

The invention further provides that comminuted material can be introduced into the air separator at a plurality of entrance ports, based on the size of the particles, and the comminution processes already undergone.

The various features of novelty which characterize the invention are pointed out with particularity in the claims annexed to and forming a part of the disclosure. For a better understanding of the invention, its operating advantages, and specific objects attained by its use, reference should be made to the drawings and descriptive matter in which there is illustrated and described a preferred embodiment of the invention. It should be recognized by those skilled in the art that the specific embodiment disclosed herein may be readily modified for carrying out the same or similar purposes as that of the present invention. Such equivalent constructions should not be deemed to depart from the spirit and scope of the present invention as set forth in the appended claims.

OBJECTS OF THE INVENTION

It is the primary object of the invention to provide an improved cyclonic air separator for use in conjunction with the compressive comminution of granular material, including cement clinker.

It is another object of the invention to provide a cyclonic air separator having a plurality of generally concentric vessels, wherein vortical wind currents within the vessels separate feed material into the various vessels based on particle size.

It is a further object of the invention to provide a cyclonic air separator having a plurality of generally concentric vessels, wherein separated feed material is withdrawn from a plurality of vessel exit ports and can be reintroduced into the air separator at a plurality of entrance ports after further processing.

BRIEF DESCRIPTION OF THE DRAWINGS

The foregoing and other objects and advantages of the present invention are better understood with reference to the following detailed description of the invention and the accompanying drawings, in which.

DETAILED DESCRIPTION

Figure 1:
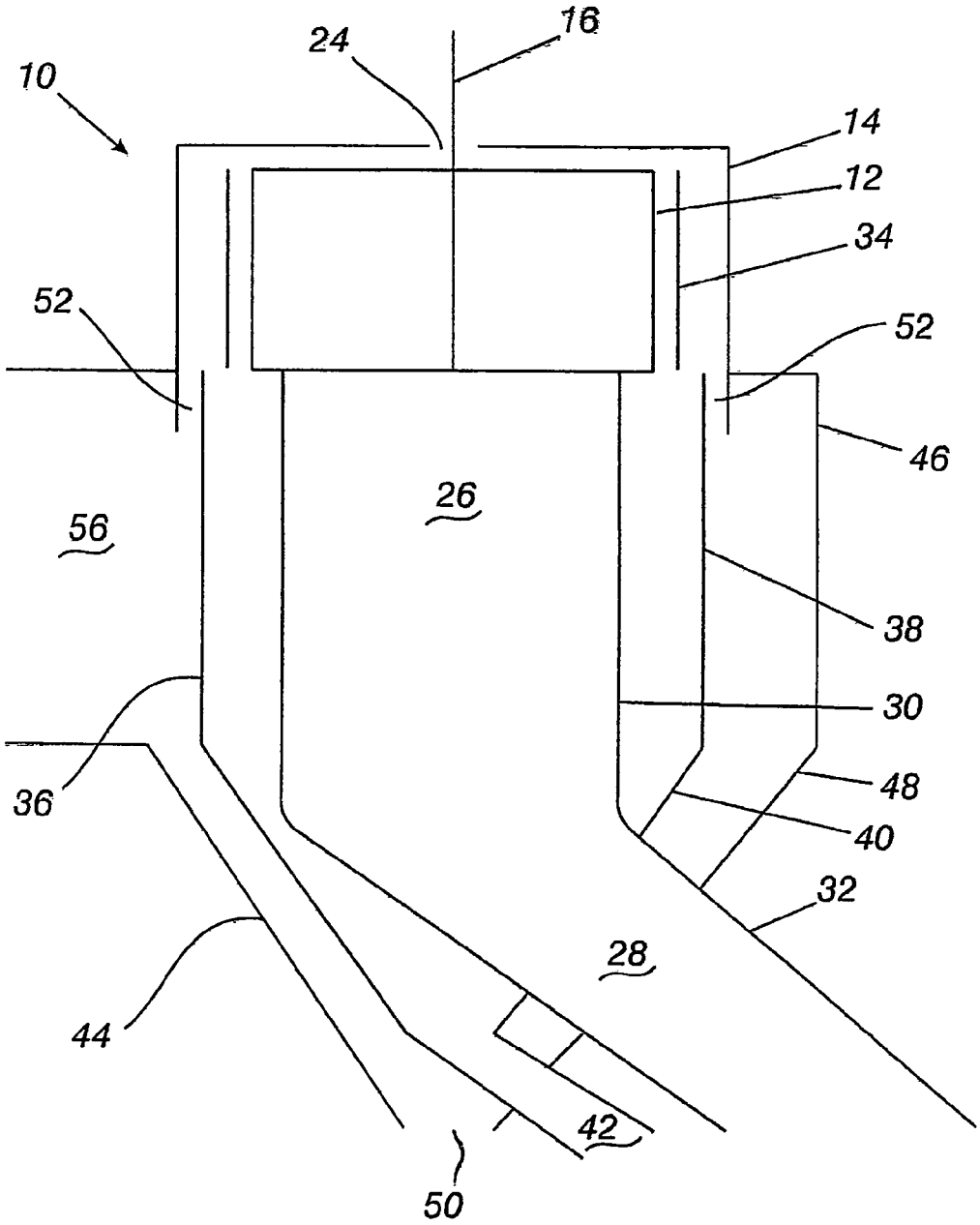
FIG. 1 is a vertical cross-sectional view of the invented air separator.

Referring now to FIG. 1, air separator 10 includes a rotor 12 centrally positioned inside a corresponding rotor housing 14 about a vertical axis. A rotary shaft 16 extends through the rotor housing 14 and is attached to the rotor 12 along a common concentric vertical axis. The rotor 12 is supported within the rotor housing 14, so that it rotates freely within the housing 14 around the vertical, shaft-defined axis.

Figure 2:
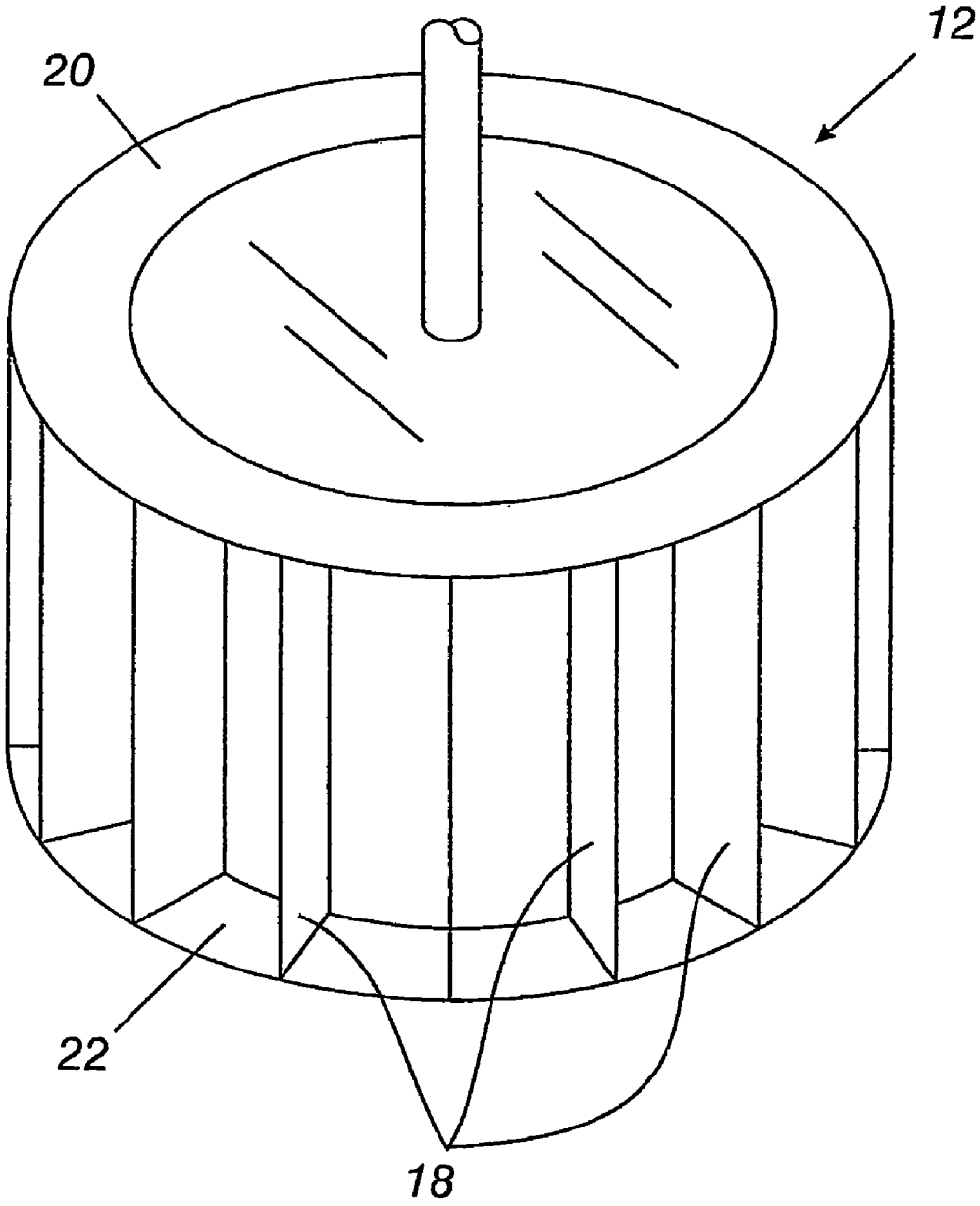
FIG. 2 is an isometric view of the rotor for use in the air separator of FIG. 1.

As shown in FIG. 2, the rotor 12 itself is a drum or fan designed to let air and small particles pass vertically inward to the interior of the drum. Thus, the rotor 12 is typically comprised of vertically extending rotor vanes 18 supported by at least an annular upper vane support 20, and preferably also by a lower annular vane support 22. The rotor vanes 18 are mounted between the upper supports 20 and lower supports 22 and are fixed into position. Upon rotation of the rotor 12, the rotor vanes 18 direct air and comminuted material into the interior of the rotor drum 12.

The rotational velocity of the rotor 12 can be altered to control the size of the particles that are allowed to pass into the rotor 12. The rotor housing 14 defines a substantially hollow cylindrical cavity wherein pre-separated material can be acted on by vortical forces created by the rotor and the rotor vanes 18.

A secondary material feed 24 is located above the rotor 12, preferably concentric with the rotary shaft 16, and extending through the surface of the rotor housing 14. Material from the secondary material feed 24 is fed directly to the rotor 12, preferably from a ball mill or other type mill capable of fine-grinding the comminuted material. Material from the secondary material feed 24 is of a sufficiently small size and dimension that it will not harm the rotor 12 or the rotor vanes 18 when fed into the rotor housing 14. It is preferable that material entering the secondary material feed 24 is of a size and dimension that would normally be carried by the vortical forces in the rotor housing 14. That is, material from the secondary feed 24 is preferably small enough to be carried by the wind currents inside the rotor housing 14.

Situated directly beneath the rotor 12 is the product duct 26. Comminuted material that is fine enough to be drawn into the rotor 12 is conducted into the product duct 26, and out of the air separator 10 through a product exit port 28. The product exit port 28 can then be connected to other machinery for settling the comminuted product from the conveying air.

The product duct 26 is comprised of two regions, the upper cylindrical portion 30 located proximate to the rotor 12, and the lower frusto-conical portion 32, located distal from the rotor 12. This profile allows for the maintenance of sufficient velocities within the product duct 26.

Preferably, the product exit port 28 is provided with a slight vacuum, such that air within the air separator 10 is drawn out through the product exit port 28. This ensures the prompt removal of finely comminuted material from the air separator 10.

Figure 3:
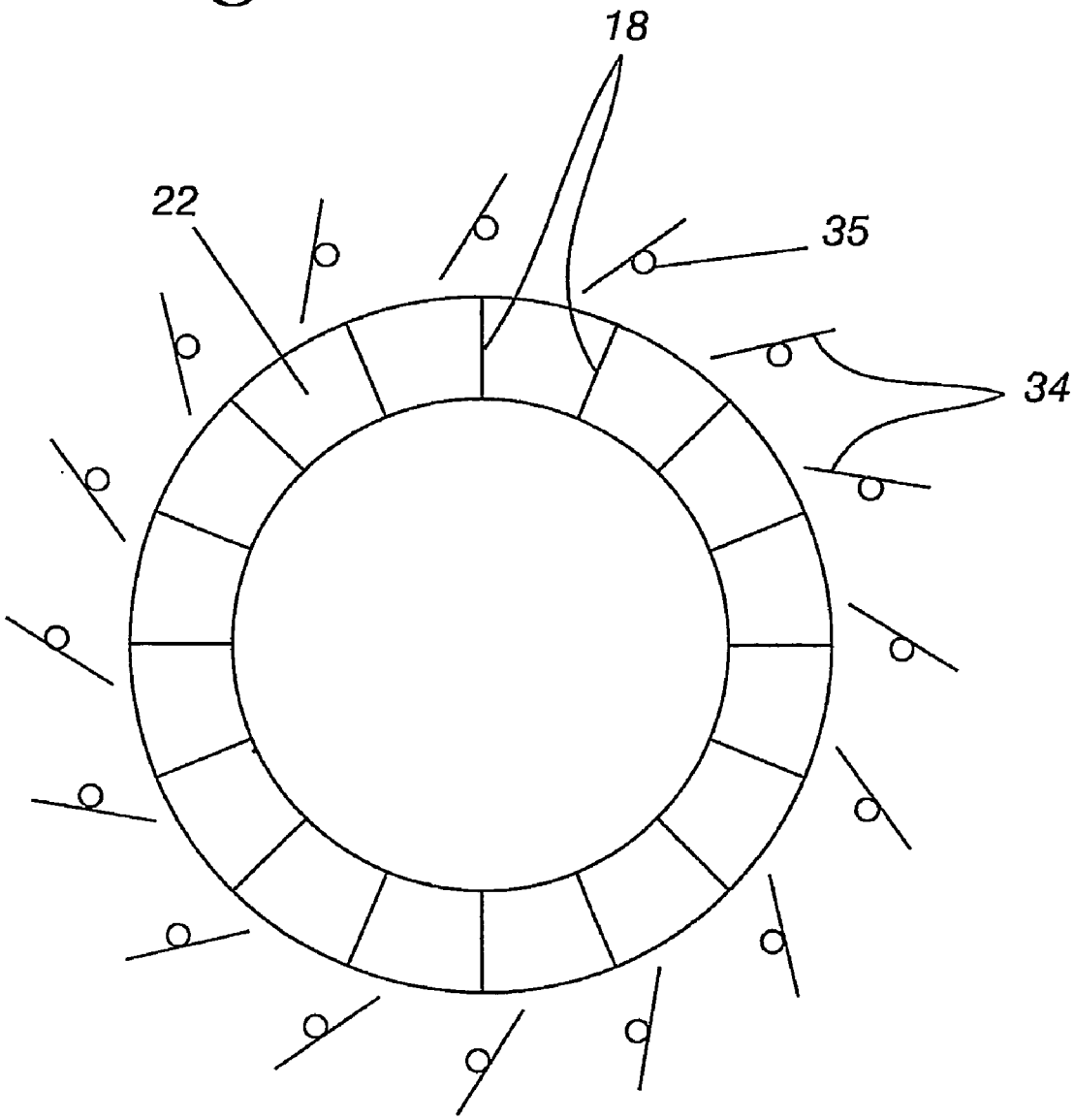
FIG. 3 is a horizontal cross-sectional view of the rotor of FIG. 2.

Material from the secondary material feed 24 that is too large to be carried by vortical forces into the rotor 12 is expelled centrifugally outward from the rotor 12. Located circumferentially between the rotor 12 and the rotor housing 14 are a plurality of angularly adjustable, stationary guide vanes 34 (which are shown schematically in FIG. 3). These vanes 34 serve to direct the separating air into the rotor 12. They are shown with associated pivots 35.

The fine rejects vessel 36 is positioned generally concentrically around the product vessel or duct 26, with the product discharge outlet or exit port 28 extending therethrough. Similar to the product vessel 26, the fine rejects vessel 36 is comprised of an upper cylindrical portion 38, and a lower frusto-conical portion 40. The upper edge of the upper portion 38 is generally coplanar with the intersection of the product vessel 26 and the rotor 12. The plurality of guide vanes 34 are connected to and extend from the top of the upper portion 38 and are also connected to the rotor housing 14.

Material collected into the fine rejects vessel 36 is directed out of the air separator 10 through discharge outlet or exit 42. Material from the exit 42 can then be redirected to a ball mill grinder for further processing, and eventual reintroduction to the air separator 10 through the secondary material feed 24.

A final coarse rejects vessel 44 is concentrically located around the fine rejects vessel 36, with both the product exit 28 and the fine rejects exit port 42 extending there through. The coarse rejects vessel 44 is comprised of an upper cylindrical portion 46, and a lower frusto-conical portion 48, similar to the fine rejects vessel 36. The annularly defined space 52 between the upper portion 38 of the fine rejects vessel 36 and the upper portion 46 of final coarse rejects vessel 44 allow for air flow from that annular space 52 upward through the plurality of guide vanes 34, and into the rotor 12.

Integrally and tangentially attached to the coarse rejects vessel is a primary material feed 56. The primary material feed 56 functions both as an air inlet and for introduction of coarsely comminuted feed material. Feed material entering the air separator 10 at the primary material feed 56 is typically material that has been passed through a first stage comminution device, such as a high pressure roll press.

Advantageously, the feed 56 is a spiral inlet, preferably having a 180° twist. Air entering the separator 10 at the primary material feed 56 creates a flow that can carry fine particles upward into the rotor housing 14 and rotor 12 for segregation between the product vessel 26 and fine rejects vessel 36. Material from the primary material feed 56 that is too heavy for transport into the rotor housing 14 is separated out of the air separator 10 into the coarse rejects vessel 44, and is discharged at the coarse rejects discharge outlet or exit 50, for further comminution.

SUMMARY OF THE ACHIEVEMENT OF THE OBJECTS OF THE INVENTION

From the foregoing, it is readily apparent that I have invented an improved cyclonic air separator for the use in conjunction with the compressive comminution of granular material, including cement clinker. The air separator is provided with a plurality of concentric, partially conical vessels. A rotor is provided atop the vessels to provide vortical wind currents within the vessels, and segregates feed material into the various vessels based on particle size. Separated feed material is withdrawn from one of a plurality of vessel exit ports for use as a final product. Withdrawn comminuted material can be reintroduced into the air separator at one of a plurality of entrance ports, based on either or both of the size of the particles, and the comminution processes already undergone.

It is to be understood that the foregoing description and specific embodiments are merely illustrative of the best mode of the invention and the principles thereof, and that various modifications and additions may be made to the apparatus by those skilled in the art, without departing from the spirit and scope of this invention.

What is claimed is:

1. An air separator for the selective separation of different sized particles comprising:

a series of concentric vessels, the separator having at least one material feed inlet and three material discharge outlets, each outlet being associated with one of said vessels;

each of said vessels being partially conical;

a top housing having an upper surface and a substantially cylindrical inner surface;

a rotary shaft extending through said upper surface, concentric with said inner surface;

a rotor concentric with said inner surface, said rotor being attached to said rotary shaft;

a second material feed extending through said upper surface to deliver unsorted materials into said top housing;

a first concentric vessel of said series of concentric vessels, said first vessel comprising a first upper portion having a tangentially aligned air inlet, and a frusto-conical first lower portion having at least one first sidewall and a first material outlet;

a second concentric vessel of said series of concentric vessels, disposed within said first concentric vessel, said second concentric vessel comprising a second upper portion and a frusto-conical second lower portion having at least one second sidewall and a second material outlet extending through said first sidewall;

a third concentric vessel of said series of concentric vessels, disposed within said first concentric vessel and positioned substantially below said rotor, said third concentric vessel comprising a third material outlet extending through said first sidewall and said second sidewall;

said first material feed being connected to said tangential air inlet; and wherein said second upper portion forms a barrier between said first upper portion and the interior of said second concentric vessel, and wherein air flow is directed from said air inlet over said barrier, through said rotor, and out said third material outlet.

2. An air separator according to claim 1, wherein said rotor is provided with vertically extending rotor vanes.

3. An air separator according to claim 1, wherein said second material feed is concentric with said rotary shaft.

4. Apparatus for the comminution of abrasive materials, said apparatus comprising:

a roll press;

a ball mill; and an air separator for the selective separation of different sized particles;

said separator comprising:

a first material inlet;

a top housing having an upper surface and a substantially cylindrical inner surface;

a rotary shaft extending through said upper surface, concentric with said inner surface;

a rotor concentric with said inner surface, said rotor being attached to said rotary shaft;

a second material feed for receiving material from said ball mill, said material feed extending through said upper surface to deliver unsorted materials into said top housing;

a first concentric vessel, said first vessel comprising a first upper portion having a tangentially aligned air inlet, and a frusto-conical first lower portion having at least one first sidewall and a first material outlet for delivering separated material to said roll press;

a second concentric vessel, disposed within said first concentric vessel, said second concentric vessel comprising a second upper portion and a frusto-conical second lower portion having at least one second sidewall and a second material outlet extending through said first sidewall for delivering separated material to said ball mill;

a third concentric vessel, disposed within said first concentric vessel and positioned substantially below said rotor, said third concentric vessel comprising a third material outlet extending through said first sidewall and said second sidewall for delivering finished product; and a first material feed connected to said tangential air inlet for receiving material from said roll press;

wherein said second upper portion forms a barrier between said first upper portion and the an interior of said second concentric vessel, and wherein air flow is directed from said air inlet over said barrier, through said rotor, and out through said third material outlet.

5. Apparatus for the comminution of abrasive materials according to claim 4, wherein said rotor is provided with vertically extending rotor vanes.

6. Apparatus for the comminution of abrasive materials according to claim 4, wherein said second material feed is concentric with said rotary shaft.

7. Apparatus for the comminution of abrasive materials according to claim 4, wherein said first material inlet is a spiral inlet.

8. Apparatus for the comminution of abrasive materials according to claim 7, wherein said spiral inlet has a 180° twist.

9. A method of segregating comminuted material for further processing comprising:

providing an air separator, said separator comprising:

a top housing having an upper surface and a substantially cylindrical inner surface;

a rotary shaft extending through said upper surface, concentric with said inner surface;

a rotor concentric with said inner surface, said rotor being attached to said rotary shaft;

a second material feed extending through said upper surface to deliver unsorted materials into said top housing;

a first concentric vessel, said first vessel comprising a first upper portion having a tangentially aligned air inlet, and a frusto-conical first lower portion having at least one first sidewall and a first material outlet;

a second concentric vessel, disposed within said first concentric vessel, said second concentric vessel comprising a second upper portion and a frusto-conical second lower portion having at least one second sidewall and a second material outlet extending through said first sidewall;

a third concentric vessel, disposed within said first concentric vessel and positioned substantially below said rotor, said third concentric vessel comprising a third material outlet extending through said first sidewall and said second sidewall;

a first material feed connected to said tangential air inlet;

wherein said second upper portion forms a barrier between said first upper portion and the an interior of said second concentric vessel, and wherein air flow is directed from said air inlet over said barrier, through said rotor, and out said third material outlet;

receiving a first material from a press roll into said first material feed;

receiving a second material from a ball mill into said second material feed; and segregating said first material and said second material for discharge at either said first material outlet, said second material outlet, or said third material outlet.

* * * * *